United States Patent [19]

Cherry

[11] 4,343,429

[45] Aug. 10, 1982

[54] OCTAGONAL BULK BIN

[75] Inventor: James H. Cherry, Marion, Iowa

[73] Assignee: Weyerhaeuser Company, Tacoma, Wash.

[21] Appl. No.: 259,628

[22] Filed: May 1, 1981

[51] Int. Cl.[3] ..... B65D 5/08

[52] U.S. Cl. ..... 229/38; 229/41 C; 229/41 D; 229/16 R; 229/39 R

[58] Field of Search ..... 229/38, 39 R, 41 C, 229/41 D, 16 R

[56] References Cited

U.S. PATENT DOCUMENTS 4,119,266 10/1978 Dempster ..... 229/39 R

*Primary Examiner*—William Price

*Assistant Examiner*—Gary E. Elkins

[57] ABSTRACT

An octagonal container closure in which the bottom closure flaps are held in place by slots formed in opposed side closure flaps. The slots are located and of a length to allow the corner and end closure flaps to extend through the slots and lock behind the side closure flaps.

4 Claims, 6 Drawing Figures

Fig. 3
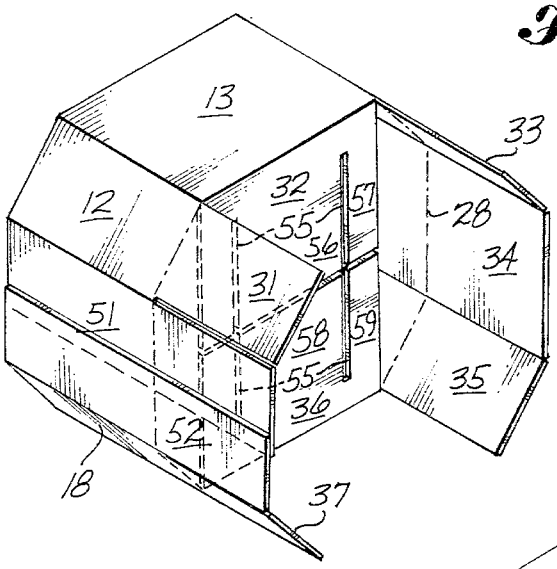
Fig. 4
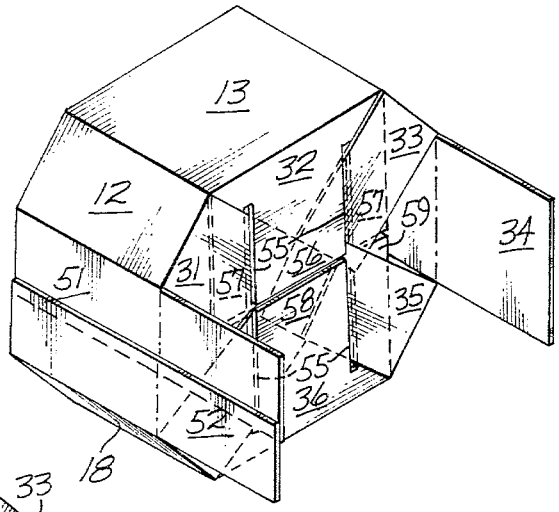
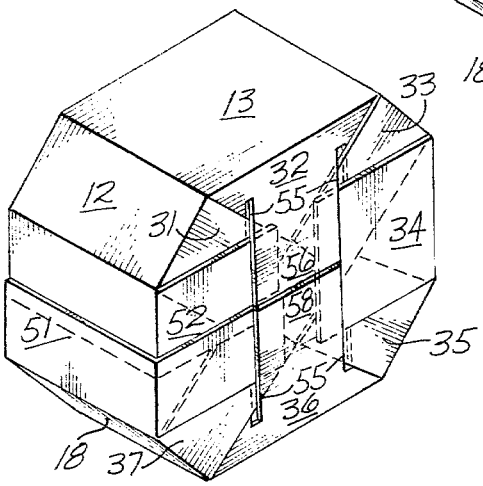
Fig. 5

OCTAGONAL BULK BIN

BACKGROUND OF THE INVENTION

1. Field of the Invention

A tubular container with a closure means.

2. Other Patents in the Field

Dempster U.S. Pat. No. 4,119,266 granted Oct. 10, 1978 discloses an octagonal tubular container with a closing means. In this container, the side closure flaps have aligned slots through which the end closure flaps extend. The corner closure flaps are within the container.

SUMMARY OF THE INVENTION

A typical octagonal bulk bin is 47 inches long, 39 inches wide and 40 inches deep. It is used for packing fresh meat and will hold between 1500 and 2300 pounds of meat. Although the container is normally carried on a pallet, it is still necessary to hold the bottom closure flaps in place during transportation and storage.

The purpose of the present octagonal container closure is to hold the bottom closure flaps in place by using locking slots in opposed side closure flaps through which the end closure flaps and corner closure flaps extend to lock behind the side closure flaps. Both the corner and end closure flaps are held within the slot.

BRIEF DESCRIPTION OF THE DRAWINGS

FIGS. 3–5 are isometric views showing the container closure being formed.

DESCRIPTION OF THE PREFERRED EMBODIMENT

Figure 1:
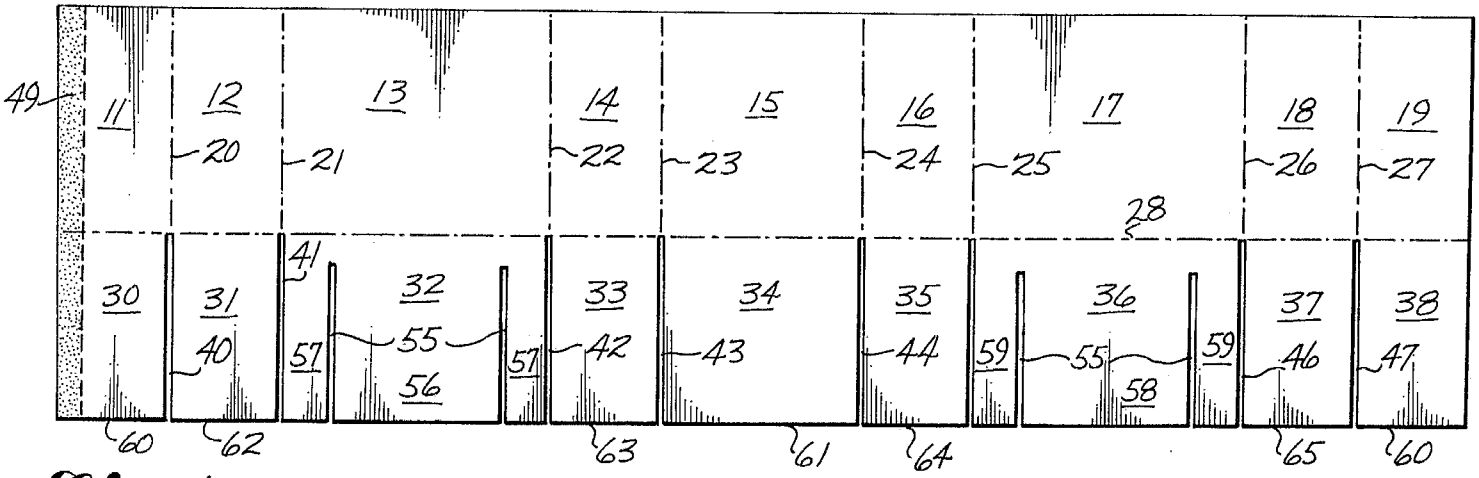
FIG. 1 is a top plan view of the blank for the container.

Blank 10 is divided into a first partial end panel 11, a first corner panel 12, a first side panel 13, a second corner panel 14, a second end panel 15, a third corner panel 16, a second side panel 17, a fourth corner panel 18 and a second partial end panel 19 by transverse scorelines 20, 21, 22, 23, 24, 25, 26 and 27. The corner panels are narrower than the side and end panels. A series of closure flaps are connected to these panels along longitudinal scoreline 28 which forms the lower edge of the panels and the hinge between the panels and closure flaps. The first partial end closure flap 30 is attached to the first partial end panel 11; the first corner closure flap 31 is attached to the first panel 12; the first side closure flap 32 is attached to the first side flap 13; the second corner closure flap 33 is attached to the second corner panel 14; the second end closure flap 34 is attached to the second end panel 15; the third corner closure flap 35 is attached to the third corner panel 16; the second side closure flap 36 is attached to the second side panel 17; the fourth corner closure flap 37 is attached to the fourth corner panel 18; and the second partial end closure flap 38 is attached to the second partial end panel 19. The panels and flaps are substantially rectangular.

The closure flaps are separated by slots which are aligned with the transverse scorelines. The slots 40, 41, 42, 43, 44, 45, 46 and 47 are aligned respectively, with scorelines 20, 21, 22, 23, 24, 25, 26, and 27.

Figure 2:
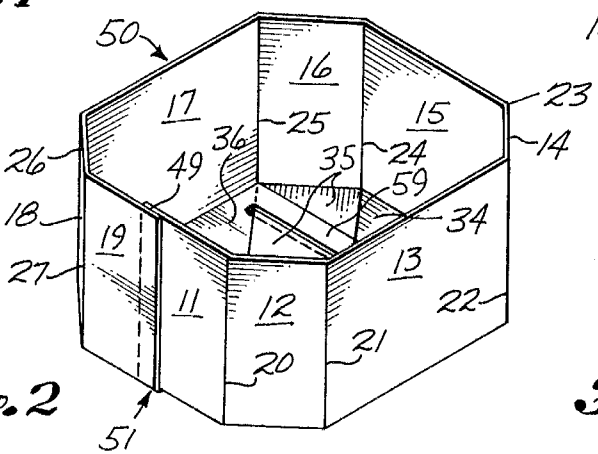
FIG. 2 is an isometric view of the formed container.

In the completed tubular container 50, shown in FIG. 2, the first partial end panel 11 and the second partial end panel 19 are adhered along manufacturers' joint 49 to form the first end panel 51 and the first partial end closure flap 30 and the second partial end closure flap 38 are adhered along manufacturers' joint 49 to form the first end closure flap 52.

The side closure flaps 32 and 36 each have a pair of slots 55. The slots 55 are located toward the side edges of the side closure flaps, and divide side closure flap 32 into a central section 56 and side sections 57, and side closure flap 36 into a central section 58 and side sections 59. The slots 55 are located from the side edges of the side closure flaps a distance that will allow the end closure flaps 34 and 52, and the corner closure flaps 31, 33, 35 and 37 to extend through the slots a distance that will allow the outer edges 60 and 61 of end closure flaps 52 and 34, and outer edges 62, 63, 64 and 65 of corner closure flaps 31, 33, 35 and 37 to overlie the central sections 56 and 59 of side closure flaps 32 and 36. The distance from the side edge will also be great enough to preserve the structural integrity of the side sections 57 and 59.

The slots are long enough to allow both the end closure flaps 52 and 34, and the corner closure flaps 31, 33, 35 and 37 to extend through them. The slots may extend slightly beyond the exterior side edges of the corner closure flaps. The exact length will depend on the relative widths of the side, end and corner panels.

Figure 6:
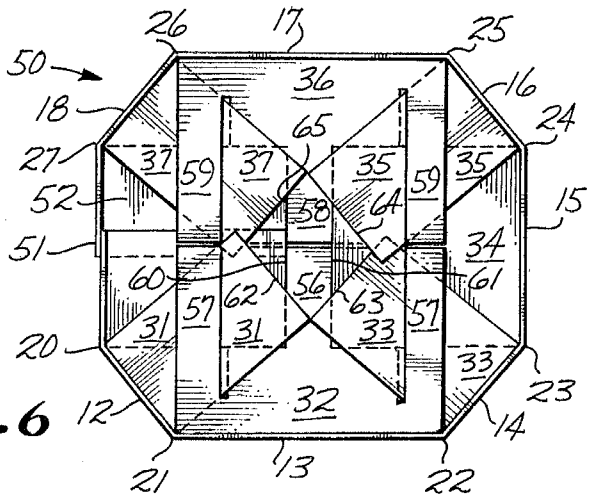
FIG. 6 is a top plan view of the container closure.

In forming the container the side closure flaps 32 and 36 are bent inwardly around scoreline 28 until they are aligned with the scoreline. The corner closure flaps 31, 33, 35, and 37 are then bent inwardly around scoreline 28 and inserted through the slots 55 into the interior of the container, overlying the central section 56 and 58 of the side closure flaps 32 and 36. The end closure flaps 52 and 34 are then bent inwardly around scoreline 28 and inserted through the slot 55 into the interior of the container beneath the corner closure flaps 31, 33, 35 and 37 and overlying the central section 56 and 58 of the side closure flaps 32 and 36 as shown in FIG. 6.

I claim:

1. The closure for an octagonal bulk bin having opposed pairs of side and end panels and opposed pairs of corner panels extending between said side and end panels, said corner panels being narrower than said side and end panels;

side closure flaps extending from and hinged to the lower edge of each of said side panels, and corner closure flap extending from and hinged to said corner panels, said bottom closure comprising in sequence;

said side closure flaps extending into said container, each of said side closure flaps having a pair of slots extending from their outer edges toward said side panels to which they are attached, said slots being substantially parallel to the sides of said side closure flap and dividing said side closure flaps into a central section and side sections, said slots extending to the exterior side edges of said corner closure flaps;

said corner closure flaps extending through said slots and being beneath said side sections and over said central sections;

said end closure flaps extending through said slots and being beneath said corner closure flaps and said side sections, and between said corner closure flaps and said central section.

2. A blank for the closure of a bulk container comprising in sequence, a first partial end panel, a first corner panel, a first side panel, a second corner panel, a second end panel, a third corner panel, a second side panel, a fourth corner panel and a second partial end panel;

said panels being hingedly connected by scorelines;

closure flaps extending form the lower edges of the said panels and being hingedly connected to said panels by a scoreline and separated from each other;

said closure panels comprising a first partial end closure flap connected to said first partial end panel, a first corner flap connected to said first corner panel, a first side closure flap connected to said first side panel, a second corner closure flap connected to said second corner panel, a second end closure flap connected to said second end panel, a third corner closure flap connected to said third corner panel, a second side closure flap connected to said second side panel, a fourth corner closure flap connected to said fourth corner panel and a second partial end closure flap connected to said second partial end panel;

said side closure flaps having pairs of slots extending from their outer edges toward said side panels to which they are attached, said slots being substantially parallel to the side edges of said side closure flaps, and extending into said side closure flap a distance equal to the distance between the outer edge of the side closure flap and the exterior side edge of said corner closure flap in the closed container.

3. The closure for an octagonal bulk bin having opposed pairs of side and end panels and opposed pairs of corner panels extending between said side and end panels, said corner panels being narrower than said side and end panels;

side closure flaps extending form and hinged to the lower edge of each of said side panels, end closure flaps extending form and hinged to the lower edge of each of said end panels, and corner closure flaps extending from and hinged to said corner panels, said bottom closure comprising in sequence;

said side closure flaps extending into said container, each of said side closure flaps having a pair of slots extending from their outer edges toward said side panels to which they are attached, said slots being substantially parallel to the sides of said side closure flap and dividing said side closure flaps into a central section and side sections, said slots extending to slightly beyond the exterior side edges of said corner closure flaps;

said corner closure flaps extending through said slots and being beneath said side sections and over said central sections;

said end closure flaps extending through said slots and being beneath said corner closure flaps and said side sections, and between said corner closure flaps and said central section.

4. A blank for the closure of a bulk container comprising in sequence, a first partial end panel, a first corner panel, a first side panel, a second corner panel, a second end panel, a third corner panel, a second side panel, a fourth corner panel and a second partial end panel;

said panels being hingedly connected by scorelines;

closure flaps extending from the lower edges of said panels and being hingedly connected to said panels by a scoreline and separated from each other;

said closure panels comprising a first partial end closure flap connected to said first partial end panel, a first corner closure flap connected to said first corner panel, a first side closure flap connected to said first side panel, a second corner closure flap connected to said second corner panel, a second end closure flap connected to said second end panel, a third corner closure flap connected to said third corner panel, a second side closure flap connected to said second side panel, a fourth corner closure flap connected to said fourth corner panel and a second partial end closure flap connected to said second partial end panel;

said side closure flaps having pairs of slots extending from their outer edges toward said side panels to which they are attached, said slots being substantially parallel to the side edges of said side closure flaps, and extending into said side closure flap a distance slightly beyond the distance between the outer edge of the side closure flap and the exterior side edge of said corner closure flap in the closed container.

* * * * *